US007850583B2

(12) United States Patent
Smith

(10) Patent No.: US 7,850,583 B2
(45) Date of Patent: Dec. 14, 2010

(54) TENSION LINE EXERCISE APPARATUS AND METHOD OF EXERCISING USING A TENSION LINE EXERCISE APPARATUS

(76) Inventor: Aaron L. Smith, 2540 N. 6th St., Harrisburg, PA (US) 17110

( * ) Notice: Subject to any disclaimer, the term of this patent is extended or adjusted under 35 U.S.C. 154(b) by 0 days.

(21) Appl. No.: 12/505,477

(22) Filed: Jul. 18, 2009

(65) Prior Publication Data

US 2009/0280969 A1 Nov. 12, 2009

Related U.S. Application Data

(63) Continuation of application No. 11/696,245, filed on Apr. 4, 2007, now Pat. No. 7,563,212.

(60) Provisional application No. 60/833,725, filed on Jul. 27, 2006.

(51) Int. Cl.
*A63B 21/02* (2006.01)
*A63B 69/34* (2006.01)

(52) U.S. Cl. ..... 482/124; 482/83

(58) Field of Classification Search ..... 482/74, 482/124, 128, 114–120, 83
See application file for complete search history.

(56) References Cited

U.S. PATENT DOCUMENTS

| | | | | |
|---|---|---|---|---|
| 475,432 | A | | 5/1892 | Blades |
| 4,441,707 | A | | 4/1984 | Bosch |
| 4,937,885 | A | * | 7/1990 | Gregg ..... 2/209.11 |
| 4,961,573 | A | | 10/1990 | Wehrell |
| 5,129,647 | A | | 7/1992 | Castellanos |
| 5,176,600 | A | | 1/1993 | Wilkinson |
| 5,209,482 | A | | 5/1993 | Hopfer |
| 5,308,305 | A | | 5/1994 | Romney |
| 5,328,432 | A | | 7/1994 | Gvoich |
| 5,358,461 | A | | 10/1994 | Bailey, Jr. |
| 5,362,295 | A | | 11/1994 | Nurge |
| 5,518,480 | A | | 5/1996 | Frappier |
| 5,618,249 | A | | 4/1997 | Marshall |
| 5,647,827 | A | | 7/1997 | Gutkowski et al. |
| 5,683,336 | A | | 11/1997 | Pape |
| 5,733,231 | A | | 3/1998 | Corn et al. |
| 5,795,274 | A | | 8/1998 | Kasbohm |
| 5,813,955 | A | | 9/1998 | Gutkowski et al. |
| 5,815,948 | A | * | 10/1998 | Dzielak ..... 36/2 R |
| 5,993,362 | A | | 11/1999 | Ghobadi |
| 6,099,447 | A | | 8/2000 | Ramsaroop |
| 6,120,422 | A | | 9/2000 | Kiemer |
| 6,213,922 | B1 | | 4/2001 | Afanasenko et al. |
| 6,280,365 | B1 | | 8/2001 | Weber et al. |
| 6,770,014 | B2 | | 8/2004 | Amore |
| 7,087,001 | B1 | | 8/2006 | Ihli |
| 7,314,437 | B2 | | 1/2008 | Frappier |
| 2001/0007845 | A1 | | 7/2001 | Afanasenko et al. |
| 2003/0054924 | A1 | | 3/2003 | Amore |
| 2005/0170937 | A1 | | 8/2005 | van Straaten |
| 2005/0261113 | A1 | | 11/2005 | Wilkinson |

* cited by examiner

*Primary Examiner*—Fenn C Mathew
(74) *Attorney, Agent, or Firm*—Dovas Law, P.C.

(57) ABSTRACT

An exercise apparatus including an elbow attachment device configured for attachment to an elbow of a user is provided. A tensioning device is configured for connection to the elbow attachment device and configured for connection to a torso of the user. The present invention also provides a method for exercising.

20 Claims, 9 Drawing Sheets

TENSION LINE EXERCISE APPARATUS AND METHOD OF EXERCISING USING A TENSION LINE EXERCISE APPARATUS

CROSS REFERENCE TO RELATED APPLICATION(S)

This application is a continuation of U.S. patent application Ser. No. 11/696,245, filed Apr. 4, 2007, which claims the benefit of U.S. provisional application No. 60/833,725, filed Jul. 27, 2006, which applications are incorporated by reference as if fully set forth.

BACKGROUND

There are a variety of different types of exercise apparatus using some form of tension line to provide exercise resistance. Often these devices provide a line formed from a highly elastic polymeric material which may be elastically deformed by a user using the user's arms or other body parts. Handles are typically connected to the tension line allowing a user to grasp the device, for example using hands or feet, and perform various body motions while subject to the resistance provided by the tension line. The result of such restricted motion is a training of the muscles and increased muscle strength. Such devices may be used in professional or amateur sports training, rehabilitation, or leisure exercise. Certain sports such as boxing are particularly suited toward such devices since a boxer can use the sprung line to provide resistance to punching motions.

Known tension line exercise apparatus are limited in that in most cases they require a user to grasp a handle with a hand in order to actuate the tension line. Accordingly, during use of one of the known devices, a user is not easily able for example to wear boxing gloves, shoot/pass a basketball, pass a football, or perform other activities which require free hands. Moreover, if a device can only be used by grasping a handle with a hand, force can only be applied at that user's hand. Certain training or rehabilitation activities may benefit from a force application away from the user's hand, for example in cases where such force application is uncomfortable to a user due to an injury or other pre-existing condition.

In view of the above, there is a need for a tension line exercise apparatus which can provide resistance without relying on handles to be grasped by a user's hands or feet. Such device should provide a force application originating at a location distanced from a user's hand, allowing the user to have free hands to engage in other activities and preventing discomfort sometimes associated with a resistance force originating at a user's hand. The device should also provide varied resistance to suit a user preference.

SUMMARY

The present invention provides an exercise apparatus including an elbow attachment device configured for attachment to an elbow of a user. A tensioning device is provided configured for connection to the elbow attachment device and configured for connection to a torso of the user.

The present invention also provides an elbow attachment device for exercising. The elbow attachment device includes an elastic sleeve for attachment to an elbow of a user, a strap slideably attached to the elastic sleeve, and a connector connected to the strap.

The present invention further provides a method of exercising. The method includes providing a first device for attachment to an elbow of a user and providing a second device elastically connected to the first device, for attachment to a torso of the user. The method further includes attaching the first device to a torso of the user and attaching the second device to an elbow of the user. The elbow of the user is motioned to resist the elastic connection between the first device and the second device.

BRIEF DESCRIPTION OF THE DRAWING(S)

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
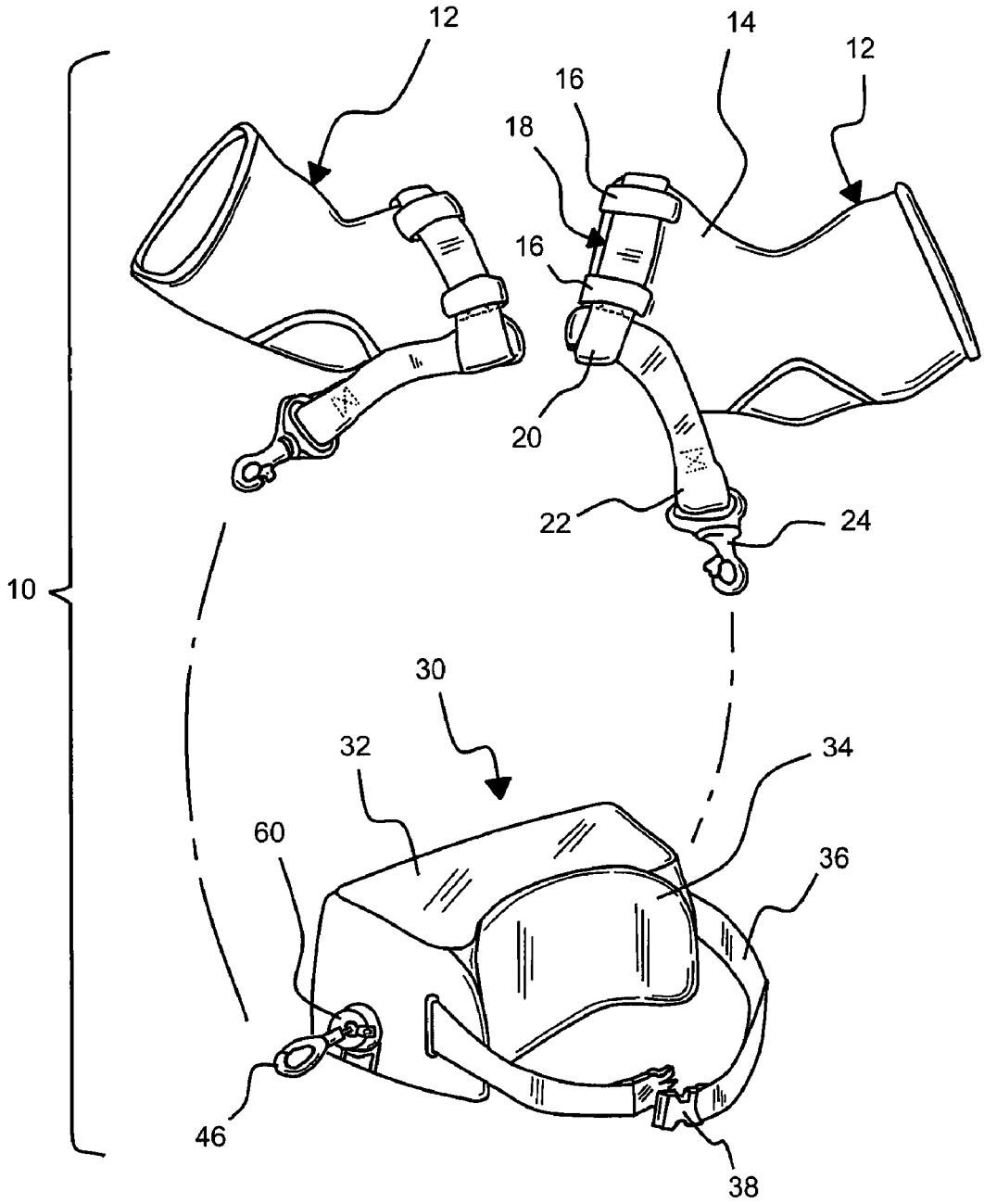
FIG. 1 is a perspective view of an exercise apparatus according to a first preferred embodiment of the present invention.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The preferred embodiments of the present invention are described below with reference to the drawing figures where like numerals represent like elements throughout.

Figure 2:
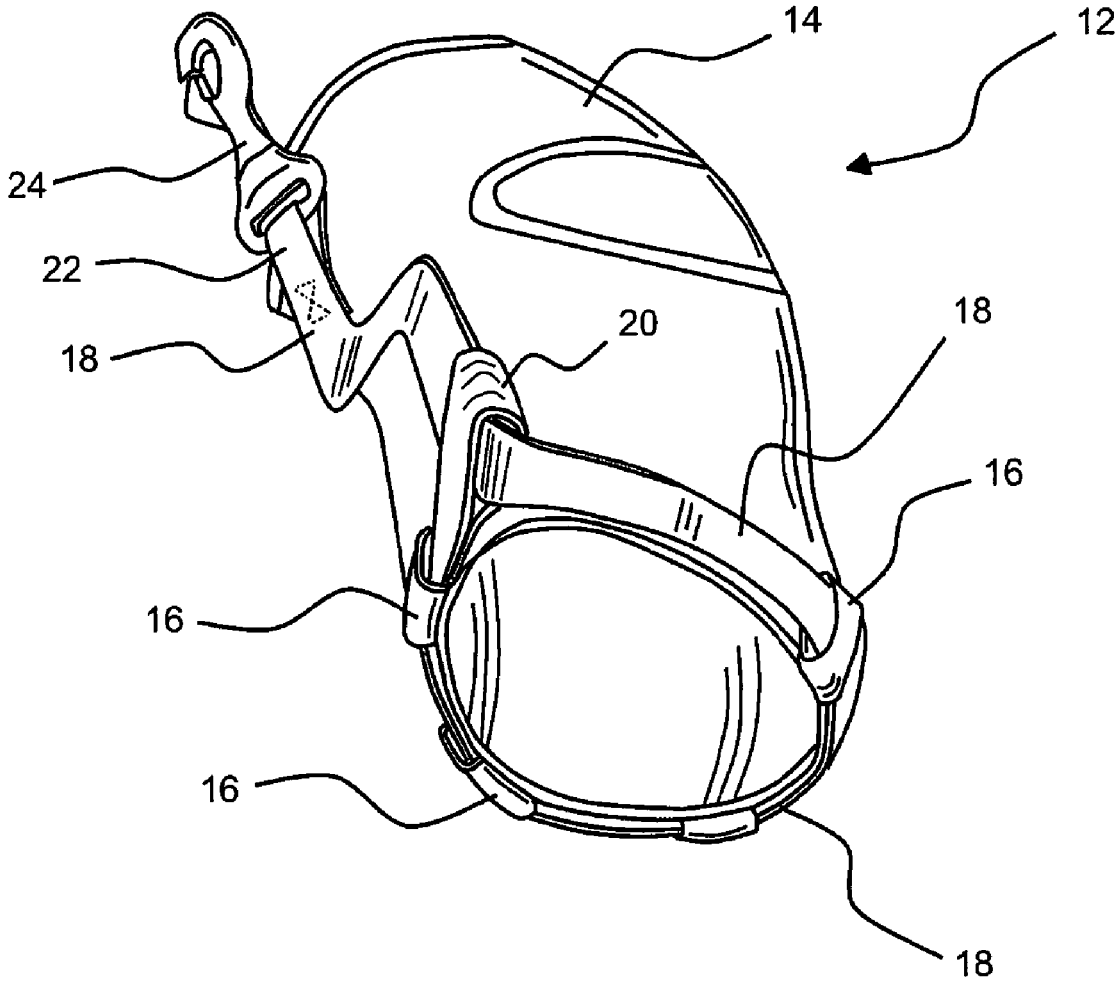
FIG. 2 is a perspective view of an elbow attachment device of the exercise apparatus of FIG. 1.
Figure 3:
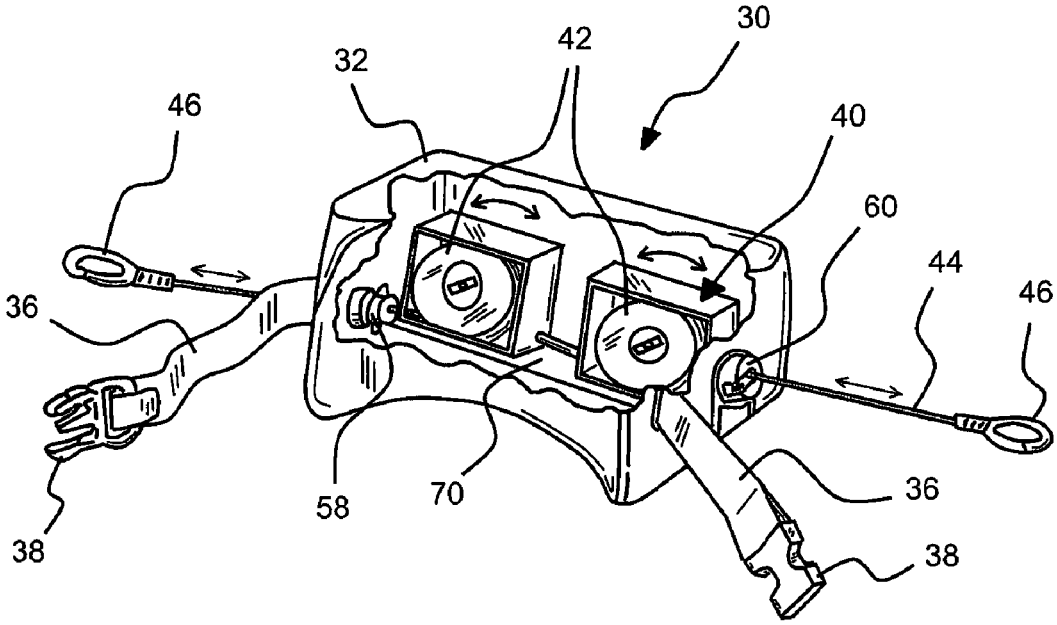
FIG. 3 is a cutaway front perspective view of a tensioning device of the exercise apparatus of FIG. 1.
Figure 4:
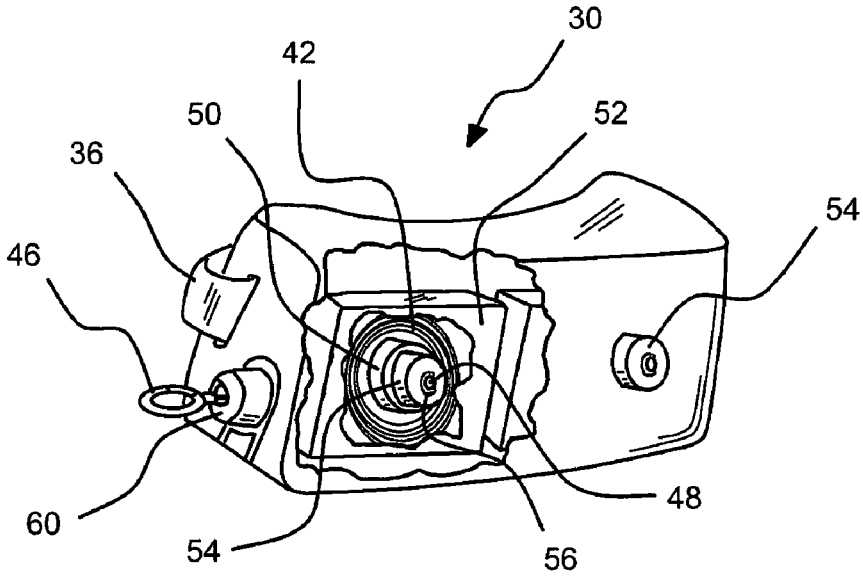
FIG. 4 is cutaway rear perspective view of the tensioning device of FIG. 3.
Figure 5:
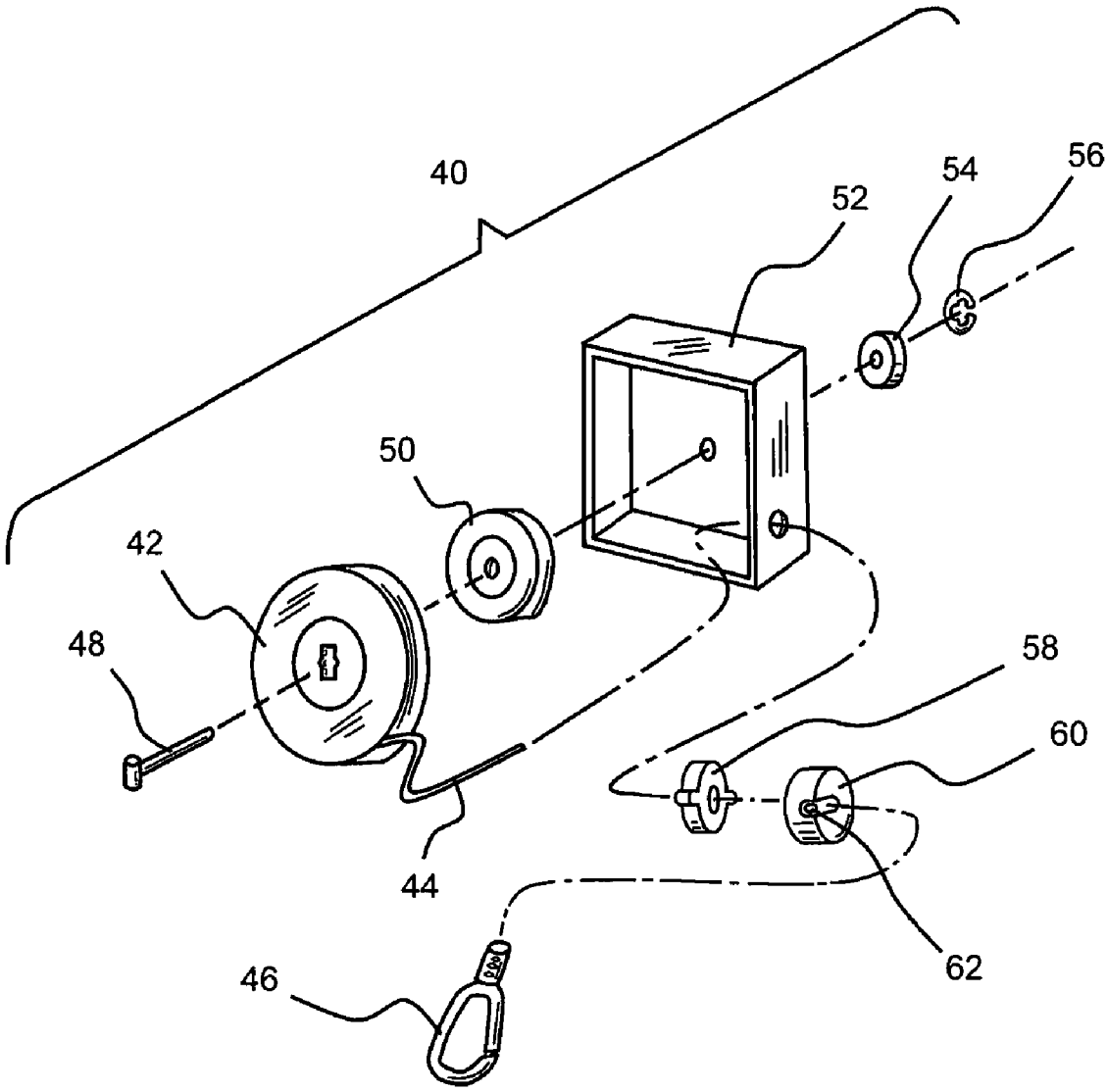
FIG. 5 is an exploded perspective view of a tension line assembly of the tensioning device of FIG. 3.

Referring to FIGS. 1 and 2, an exercise apparatus 10 according to a preferred embodiment of the present invention is shown. The exercise apparatus 10 includes first and second elbow attachment devices 12 which are preferably identical. The elbow attachment devices 12 are configured for removable attachment to a tensioning device 30 which is configured for connection to a torso of a user.

Each elbow attachment device 12 includes a sleeve 14 preferably including a suitable elastic polymeric material. The sleeve 14 may include woven or non-woven material and may have an angled contoured form as shown or be generally cylindrical in shape. Loops 16 are attached to the sleeve 14 around a perimeter thereof. The loops 16 are preferably sewn to the sleeve 14 using an aggressive stitch pattern to prevent detachment. While four loops 16 are shown on each sleeve 14, alternatively any suitable number of loops can be used. Even a single long extended loop may be used if desired.

A strap 18, preferably formed of a strong and flexible fabric material, is slideable through the loops 16. The strap 18 preferably includes a first looped portion 20 at a first end thereof and a second looped portion 22, which retains a first connector 24, at a second end thereof. The first connector 24 is provided for removably connecting the elbow attachment device 12 to the tensioning device 30. Alternatively, the first connector 24 may be omitted, and the strap 18 may be connected to the tensioning device 30 in another suitable manner for example by using only the second looped portion 22. The first and second looped portions 20, 22 are created by stitching the ends of the strap 18 with an aggressive stitch pattern. The second end of the strap 18 with the first connector 24 passes through the first looped portion 20 creating a noose such that the strap 18 may provide a cinching action on the sleeve 14 when a force is applied to the second end of the strap 18.

Referring to FIGS. 1-5, the tensioning device 30 comprises a body 32 including a contoured surface 34 for positioning on a rear torso of a user. A belt 36, which is attached to the body 32, includes buckles 38 for connecting the tensioning device 30 to a user.

Within the body 32, tension line assemblies 40 are provided. Tension line assemblies 40 preferably include reel springs 42 having wound bands of steel strip which provide generally constant force loading throughout an operating range. Alternatively, any other suitable spring types can be provided. Lines 44 are connected to the bands of steel strip of the reel springs 42 such that the lines 44 are elastically retractable from the body 32. Second connectors 46 are attached to the lines 44 for removable connection to the first connectors 24. Preferably, each line 44 is subject to a countering force provided by one of the springs 42 from a point where the second connector 46 is disposed in close proximity to the body 32, as shown in FIG. 1, to a full extension of the line 42. Lines 44 are preferably constructed of steel with a polymeric coating and provide negligible elasticity during use. Alternatively, other suitable materials can be used. For example, the lines 44 can be entirely fabricated from high strength and high elastic modulus polymeric materials.

Each tension line assembly 40 preferably includes a spool pin 48 which retains the reel spring 42 and a double shield bearing 50 within a housing 52. A spool pin cap 54 and a spool pin retainer clip 56 are installed external to the body 32 for removably securing the spool pin 48. The line 44 passes through an inner line bearing 58 mounted within the body 32 and an outer line bearing 60 rotatably connected to the inner line bearing 58 and positioned outside the body 32. The outer line bearing 60 freely rotates and includes a roller cable director 62 for reducing friction, whereby the line 44 may be extended in various angles relative to the body 32 while engaging the roller cable director 62. The reel spring 42 is replaceable by a user and may be removed through an access door 70 positioned at the bottom of the body 32. Accordingly, a user may replace the spring reel 42 with a new spring reel 42 providing a greater or lesser retracting force to suit a particular exercise preference. Alternatively, adjustable force reel springs can be provided permitting a user to adjust the force of the reel springs, for example using a turn key or a knob external to the body 32.

Figure 6:
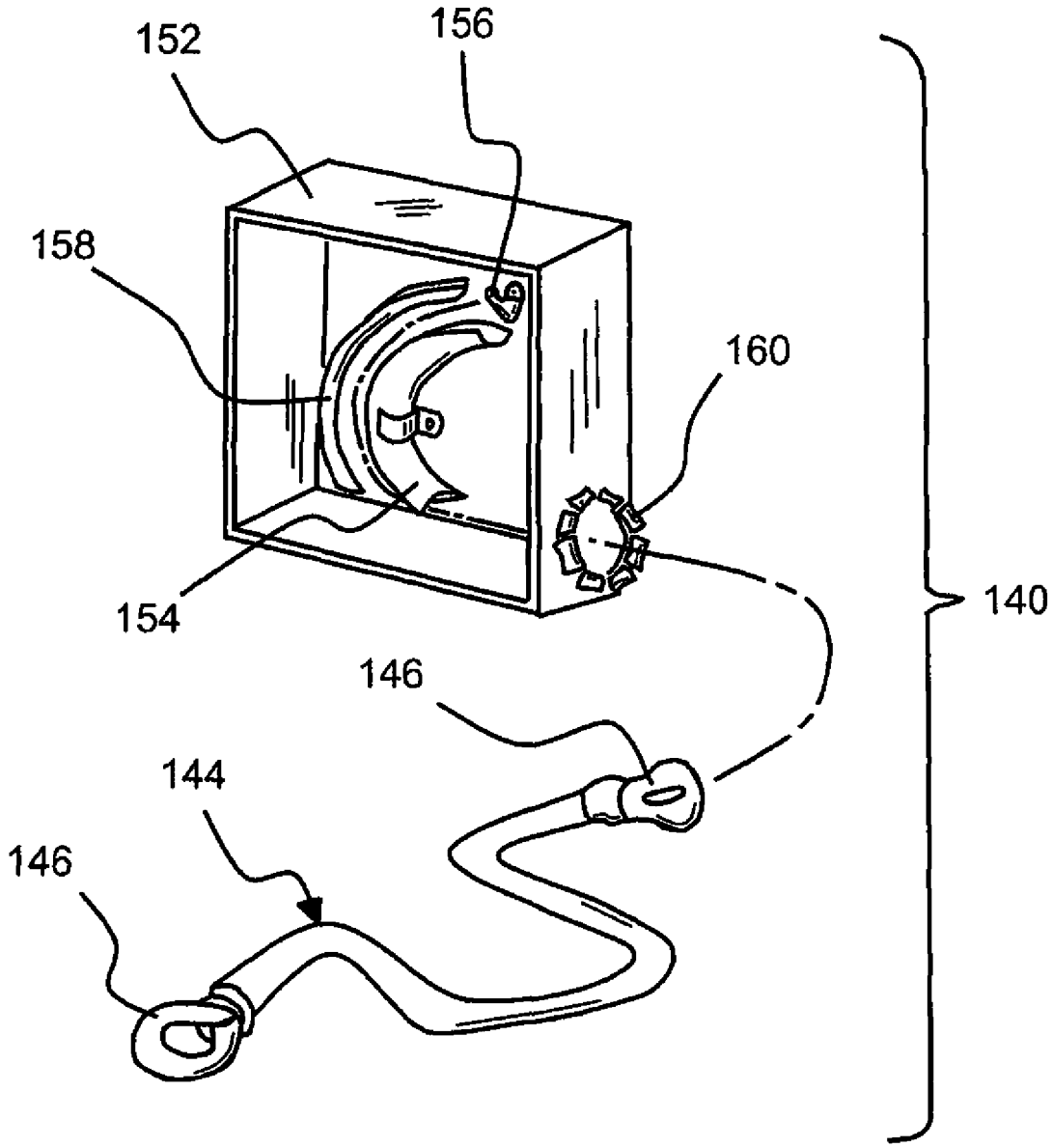
FIG. 6 is an exploded perspective view of a tension line assembly for use in a tensioning device according to a second preferred embodiment of the present invention.
Figure 8:
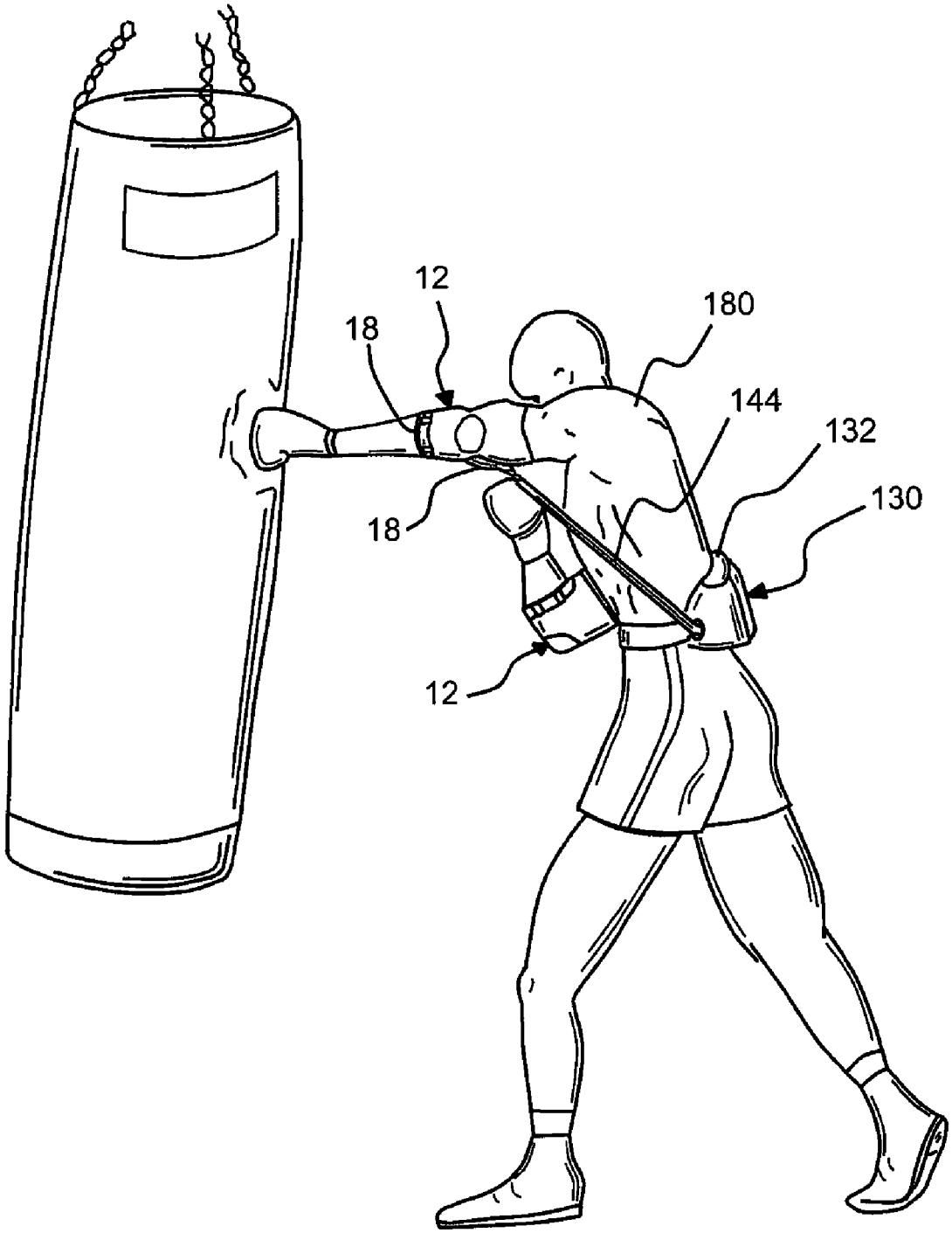
FIG. 8 is a perspective view of a user using an exercise apparatus including the tensioning device according to the second preferred embodiment of the present invention.

Referring to FIGS. 6 and 8, a tension line assembly 140 for use in a tensioning device 130 according to a second preferred embodiment of the present invention is shown. The tension line assembly 140 comprises a housing 152 with a tube holster 154 attached thereto. An elastic tension line 144 is preferably provided for attachment to the housing 152. The elastic tension line 144 preferably includes an elastic polymeric material which functions as a spring due to a low elastic modulus of its constituent materials. The elastic tension line 144 is preferably stretchable to a length of more than double its unstretched length without failure in a manner typical of exercise bands used for fitness activities. Connectors 146 are provided at the ends of the elastic tension line 144. A retaining tab 156 is attached to the housing for connection with one of the connectors 146. When installed, the elastic tension line 144 is removably positioned between the holster 154 and a retaining shield 158 attached to the housing 152. A roller bearing assembly 160 is preferably provided for reducing friction on the elastic tension line 144 during use. The elastic tension line 144 can be replaced with another elastic tension line 144 having a larger or smaller elastic modulus to accommodate a user's preference for resistance.

Figure 7:
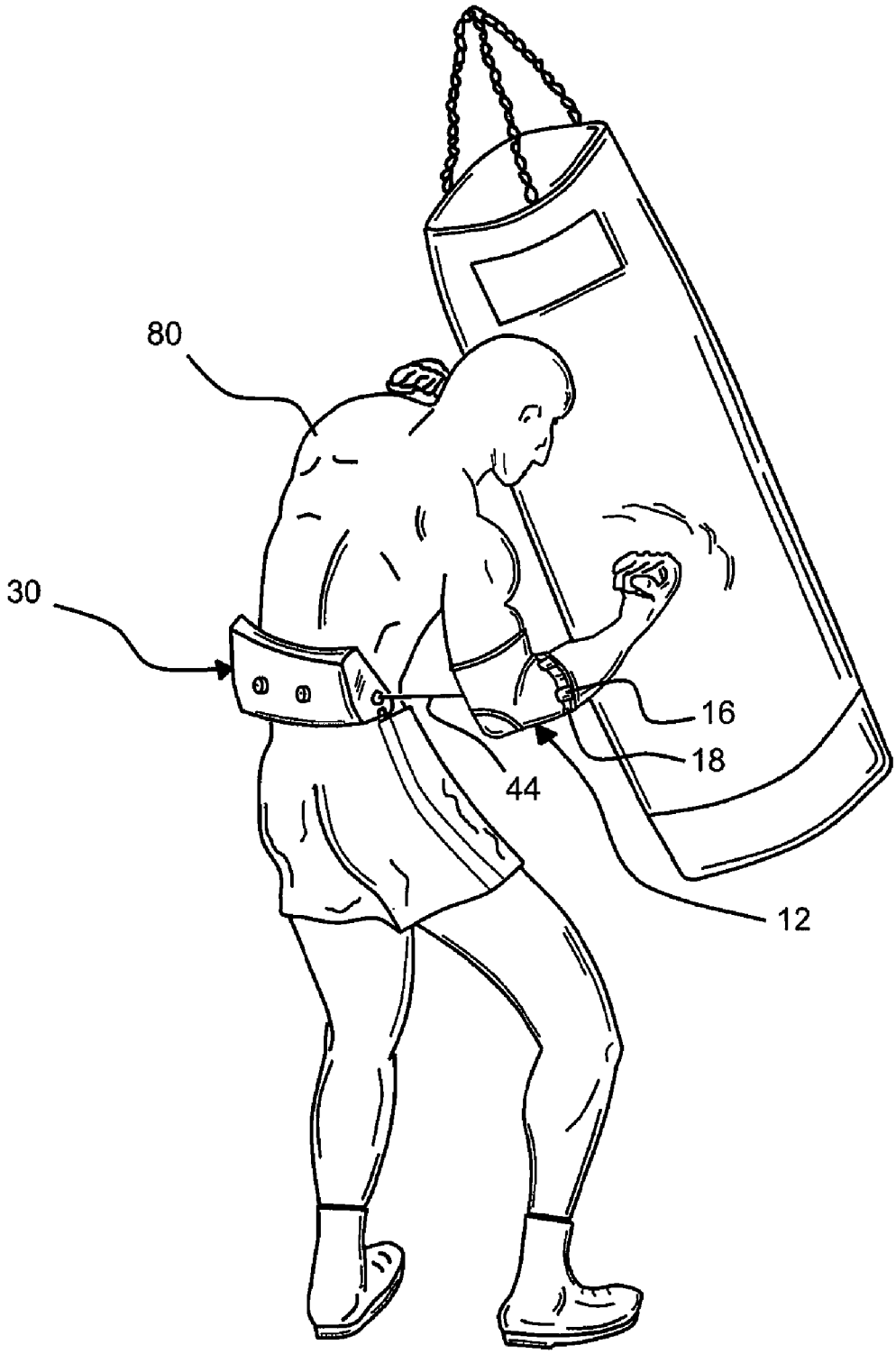
FIG. 7 is a perspective view of a user using the exercise apparatus of FIG. 1.

Referring to FIG. 7, a user 80 is shown using the exercise apparatus 10 to exercise according to a preferred embodiment of the present invention. The tensioning device 30 is shown attached to the user's waist, and the elbow attachment devices 12 are shown attached to the user's elbows. As the user 80 motions his elbows, the tensioning device 30 provides resistance through the lines 44. The resisting force is substantially constant during the entire range of elbow motion of the user since constant force type reel springs 42 are used. Such elbow motion results from many common athletic movements, for example throwing a punch or passing a ball, or performing various arm reaching exercises. While not wishing to be limited by any theory of functionality of the invention, the noose formed by the strap 18 tightens around the forearm of the user 80 when resistance is provided to the strap 18 by the tensioning device 30, preventing the elbow attachment device 12 from sliding from its position on the user's elbow during use. This noose configuration also permits various users with different arm sizes to comfortably use the elbow attachment devices 12.

Referring to FIG. 8, a user 180 is shown wearing the tensioning device 130 of the second preferred embodiment, including the tension line assemblies 140, in conjunction with the elbow attachment devices 12. In contrast to the constant force reel springs 42 of the tensioning device 30 of the first preferred embodiment, the elastic tension lines 144 provide increasing resisting force on the elbow attachment device 12 as the elbow of the user 180 motions away from a body 132 of the tensioning device 130.

Figure 9:
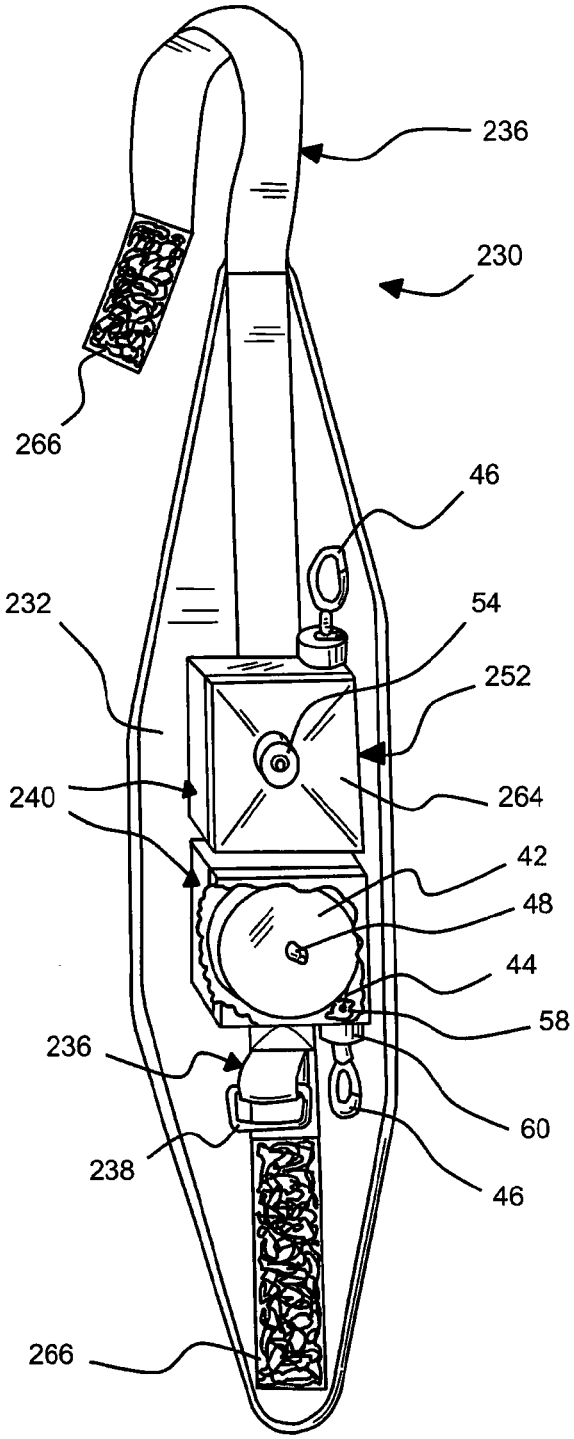
FIG. 9 is a perspective view of a tensioning device according to a third preferred embodiment of the present invention.

Referring to FIG. 9, a tensioning device 230 according to a third preferred embodiment of the present invention is shown. The tensioning device 230 includes a flat body 232 which is preferably a flat piece of sturdy flexible sheet which may include leather, suitable polymeric materials, woven or non-woven material, or any suitable material or materials. The flat body 232 is preferably configured to be flexible enough to bend to the contour of a user's torso when worn around a user's waist. Tension line assemblies 240 are provided. Each tension line assembly 240 includes a housing 252 including a cover 264. A reel spring 42 is replaceably positioned within each housing 252, and the spool pin 48 passes through the reel spring 42 and the cover 264. The spool pin cap 54 and a spool pin retainer clip 56 are installed external to the cover 264. The line 44 passes through the inner line bearing 58 mounted within the housing 252 and the outer line bearing 60 is rotatably connected to the inner line bearing 58 and positioned outside of the housing 252. A releasable belt strap 236 is preferably provided for securing the tensioning device 230 to the torso of a user. The releasable belt strap 236 preferably includes a buckle 238 and hook and loop or hook and hook fastening surfaces 266 for connecting ends of the strap 236. Alternatively, any suitable connecting devices can be used for attaching the tensioning device 230 to a user.

Figure 10:
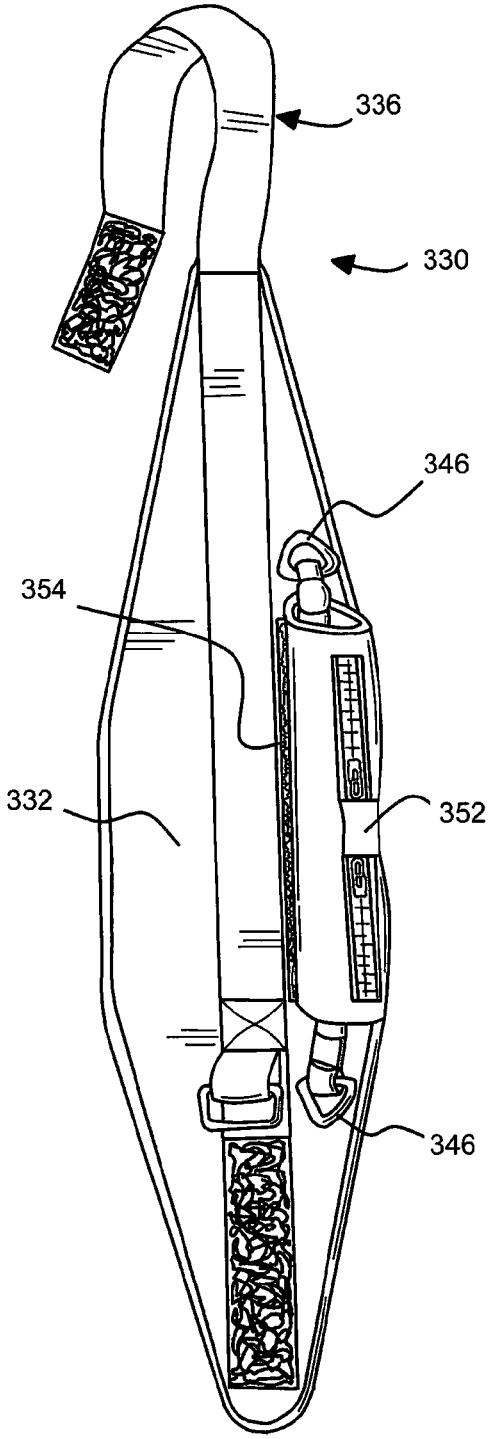
FIG. 10 is a perspective view of a tensioning device according to a fourth preferred embodiment of the present invention.

Referring to FIG. 10, a tensioning device 330 according to a fourth preferred embodiment of the present invention is shown. The tensioning device 330 includes a flat body 332 having a releasable belt strap 336 configured in the manner of the third preferred embodiment of the present invention. An anchor sleeve 352 is preferably provided which is removably connected to the body 332 via hook and loop or hook and hook fastening surfaces 354. The anchor sleeve 352 includes connectors 346 for attaching the anchor sleeve 352 to elastic tension lines, for example the elastic tension line 144 shown in FIG. 6.

Figure 11:
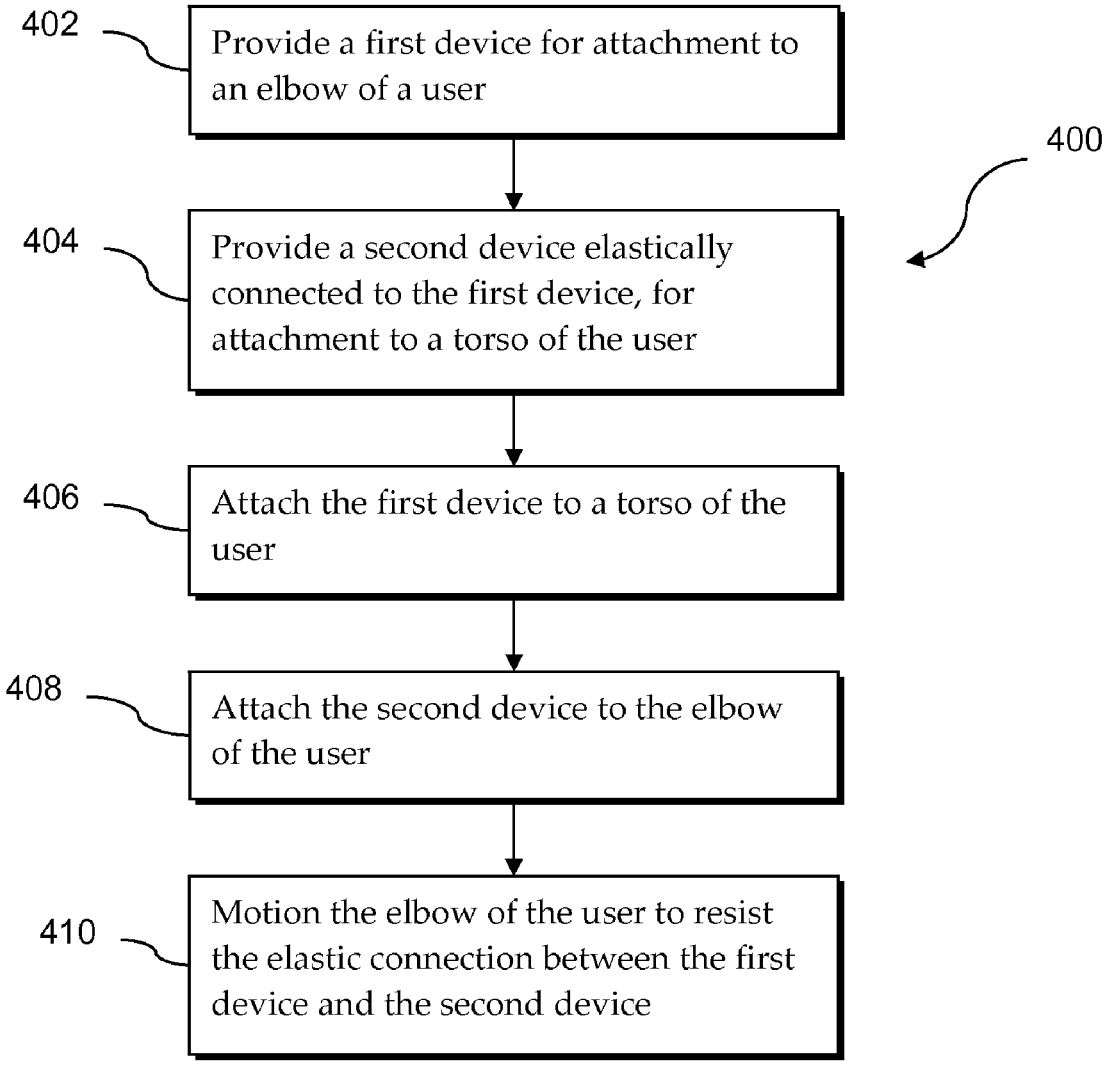
FIG. 11 is a flowchart showing a method of exercising according to a preferred embodiment of the present invention.

Referring to FIG. 11, a method 400 of exercising according to a preferred embodiment of the present invention is shown. The method 400 comprises providing a first device for attachment to an elbow of a user (step 402), and providing a second device elastically connected to the first device, for attachment to a torso of the user (step 404). The elastic connection may be provided via constant force springs, elastic tension lines, or alternatively via any suitable configuration. The first device is attached to the torso of the user (step 406). The second device is attached to the elbow of the user (step 408). The elbow of the user is motioned to resist the elastic connection between the first device and the second device (step 410).

While the preferred embodiments of the invention have been described in detail above, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. An exercise apparatus comprising:

at least one elbow attachment device configured for attachment to an elbow of a user, the at least one elbow attachment device comprising:

a sleeve defining an aperture for receiving an arm of a user; and at least one strap encircling the sleeve cinchably attached to the sleeve around the aperture for receiving the arm of the user; and a tensioning device releasably connected to the at least one strap of the at least one elbow attachment device and configured for connection to a torso of the user, wherein pulling of the at least one strap by the tensioning device cinches the sleeve around the arm of the user, whereby the aperture is decreased in size and the sleeve is tightened around the arm of the user.

2. The exercise apparatus of claim 1, wherein the at least one elbow attachment device comprises a first elbow attachment device and a second elbow attachment device, and wherein the tensioning device comprises a first line for connection to the first elbow attachment device and a second line for connection to the second elbow attachment device.

3. The exercise apparatus of claim 1, wherein the at least one elbow attachment device comprises a connector connected to the at least one strap configured for removable connection to the tensioning device.

4. The exercise apparatus of claim 3, wherein the connector connected to the at least one strap comprises at least one of a looped portion of the strap and a removable connecting device attached to the looped portion of the strap.

5. The exercise apparatus of claim 1, wherein the at least one elbow attachment device further comprises at least one loop connected in at least one location around a perimeter of the sleeve, wherein the at least one strap slideably passes through the at least one loop and around the perimeter of the sleeve forming a noose around the sleeve for cinching the sleeve.

6. The exercise apparatus of claim 1, wherein:

the at least one elbow attachment device further comprises a plurality of loops connected around a perimeter of the sleeve; and wherein the at least one strap slideably passes through the plurality of loops and around the perimeter of the sleeve forming a noose around the sleeve for cinching the sleeve.

7. The exercise apparatus of claim 1, wherein the at least one strap is configured as a noose around the sleeve for cinching the sleeve.

8. The exercise apparatus of claim 1, wherein the tensioning device comprises:

at least one spring;

at least one line connected to the at least one spring; and at least one connector connected to the at least one line for removably attaching the tensioning device to the at least one strap of the at least one elbow attachment device.

9. The exercise apparatus of claim 1, wherein the tensioning device comprises:

at least one constant force spring;

at least one line connected to the at least one constant force spring; and at least one connector connected to the at least one line for removably attaching the tensioning device to the at least one strap of the at least one elbow attachment device.

10. The exercise apparatus of claim 1, wherein the tensioning device comprises:

at least one elastic line; and at least one connector connected to the elastic line for removably connecting the tensioning device to the at least one strap of the at least one elbow attachment device.

11. The exercise apparatus of claim 1, wherein the tensioning device comprises:

a body;

a belt connected to the body for attaching the body to the waist of the user; and at least one line connected to the body and connected to the at least one strap of the at least one elbow attachment device.

12. The exercise apparatus of claim 1, wherein the tensioning device comprises:

a belt for attaching to the waist of the user; and at least one elastic line connected to the belt and connected to the at least one strap of the at least one elbow attachment device.

13. The exercise apparatus of claim 1, wherein the tensioning device comprises:

a belt for attaching to the waist of the user; and at least one elastic line removably connected to the belt and removably connected to the at least one strap of the at least one elbow attachment device.

14. An exercise apparatus comprising:

at least one attachment device comprising:

a sleeve defining an aperture for receiving an arm of a user; and at least one strap encircling the sleeve cinchably attached to the sleeve around the aperture for receiving the arm of the user; and a tensioning device releasably connected to the at least one strap of the at least one attachment device and configured for connection to a torso of the user, wherein pulling of the at least one strap by the tensioning device cinches the sleeve around the arm of the user, whereby the aperture is decreased in size and the sleeve is tightened around the arm of the user.

15. The exercise apparatus of claim 14, wherein the tensioning device comprises an elastic line.

16. A method for exercising comprising:

providing an attachment device comprising a cinching device for tightening the attachment device around an arm of a user;

providing a tensioning device;

connecting the attachment device to an arm of the user;

connecting the tensioning device to the cinching device of the attachment device;

motioning an elbow of the user to resist the connection between the tensioning device and the attachment device; and cinching the attachment device around a forearm of the user in proximity to the elbow of the user with the cinching device by motioning the elbow of the user whereby the attachment device is tightened around the forearm of the user.

17. The method of claim 16, further comprising:

providing the attachment device with a sleeve with the cinching device attached to the sleeve; and cinching the sleeve with the cinching device.

18. The method of claim 16, further comprising:

providing the tensioning device with at least one elastic line; and elastically connecting the elastic line to the attachment device.

19. The method of claim 16, further comprising connecting the tensioning device to a torso of the user wherein an opposing force is provided by the torso against the motioning of the elbow.

20. The method of claim 16, further comprising providing the cinching device with a strap, and cinching the strap around the forearm of the user by the motioning of the elbow.

* * * * *